US008939239B2

(12) United States Patent
Marchand et al.

(10) Patent No.: US 8,939,239 B2
(45) Date of Patent: Jan. 27, 2015

(54) VEHICLE FOR THE TRANSPORT OF CONSTRUCTION MATERIALS IN HARD TO REACH AREAS

(71) Applicants: Trevor George Marchand, Rosetown (CA); Clement Robert Marchand, Rosetown (CA)

(72) Inventors: Trevor George Marchand, Rosetown (CA); Clement Robert Marchand, Rosetown (CA)

( * ) Notice: Subject to any disclaimer, the term of this patent is extended or adjusted under 35 U.S.C. 154(b) by 0 days.

(21) Appl. No.: 14/197,188

(22) Filed: Mar. 4, 2014

(65) Prior Publication Data

US 2014/0251703 A1 Sep. 11, 2014

(51) Int. Cl.
*B28C 5/08* (2006.01)

(52) U.S. Cl.
CPC ..... *B28C 5/085* (2013.01); *B28C 5/0856* (2013.01)
USPC ..... 180/53.4; 366/61; 366/62

(58) Field of Classification Search
USPC ..... 180/53.4, 53.8; 366/44, 47, 53, 54, 61, 366/62, 63
See application file for complete search history.

(56) References Cited

U.S. PATENT DOCUMENTS

| | | | | | |
|---|---|---|---|---|---|
| 2,729,435 | A * | 1/1956 | Harbers et al. | ..... | 366/61 |
| 3,062,515 | A * | 11/1962 | Green | ..... | 366/47 |
| 3,173,258 | A * | 3/1965 | Hare et al. | ..... | 60/399 |
| 3,321,190 | A * | 5/1967 | Mott | ..... | 366/64 |
| 3,705,638 | A * | 12/1972 | Shock | ..... | 180/14.3 |
| 5,226,497 | A * | 7/1993 | Beaton | ..... | 180/53.4 |
| 5,868,494 | A * | 2/1999 | Campbell et al. | ..... | 366/47 |
| 7,048,430 | B2 * | 5/2006 | Birmingham et al. | ..... | 366/57 |
| 7,896,538 | B2 * | 3/2011 | Wright | ..... | 366/61 |
| 2009/0321154 | A1 * | 12/2009 | Johnson | ..... | 180/53.4 |

* cited by examiner

*Primary Examiner* — Drew Brown
(74) *Attorney, Agent, or Firm* — Steven M. Greenberg; CRGO Law

(57) ABSTRACT

This invention is a vehicle for the transportation of construction materials in hard to reach areas, which includes: a chassis composed of transverse and lateral axles; tires to transport the vehicle; a transmission system; a steering and speed control system; a pair of fixed posts on the chassis, arranged vertically and parallel to each other, to form an area where a means to contain the construction material to be transported is placed. Where the building materials are cement, concrete, reinforced concrete, lime and sand mixtures, blocks, and bricks, among others.

20 Claims, 8 Drawing Sheets

VEHICLE FOR THE TRANSPORT OF CONSTRUCTION MATERIALS IN HARD TO REACH AREAS

CROSS-REFERENCE TO RELATED APPLICATIONS

This application claims priority to Mexican Patent Application Serial Number MX/U/2013/000112, filed on Mar. 5, 2013, and entitled VEHICLE FOR THE TRANSPORT OF CONSTRUCTION MATERIALS IN HARD TO REACH AREAS, the entirety of which is incorporated herein by reference.

TECHNICAL FIELD

This invention is related to the technical fields of mechanics and construction, specifically the transporting of construction materials to hard to reach areas, as it provides an autonomous and towable vehicle for this purpose.

BACKGROUND ART

Currently, there are an endless number of concrete mixing machines, from the ones that include means that make them towable, to those that include vehicles that allow them to be self-propelled.

Patent MX169328 concerns a mobile system to mix and distribute a mixture such as concrete. Characterized by the fact that it comprises: a vehicle; a drum mixer mounted for rotation at the back of the vehicle, the drum mixer has an external wall that creates a mixing space within the drum mixer; a blade within the mixer space to mix and guide a substance into the mixer space when the drum mixer is made to turn, the blade is constructed of a lightweight abrasion-resistant polymeric material. The weight of the system is reduced compared to systems known so far; and there is an element to secure the blade in the external wall.

Transportable machines have also been developed that seek to simplify and at the same time increase the efficiency of the methodologies applied on the job, as well as the construction procedures, this is the case of concrete mixers such as the one mentioned in U.S. Pat. No. 5,492,402, which describes the combination of a trailer and a self-propelled vehicle endowed with a concrete mixer, which provides the ability to rapidly reach the work site, and then transport and efficiently place the concrete mixture in the work site.

In order to simplify the concrete mixing machines or systems, many compact and self-propelled machines, such as, for example, the one in patent document CN201385381, a portable concrete mixer is described, which is comprised of a cylinder connected to a set of rotating mounts and a rotation axis; a hand wheel is mounted on one end of the cylinder, a ring gear set is mounted on the middle of the cylinder and is coupled to a pinion that is mounted on the other end of the cylinder, the pinion and a belt pulley are coaxial, the pinion is driven by an engine mounted on the side wall of a mixer support, and the body of the cylinder and the rotary mount support are mounted on the upper part of the mixer support. The mixer's cylinder with the special structure is attachable and towable. The manufacturing cost and the requirements of the process are reduced, the complete machine structure is compact, the weight is light, the volume is small, and a wheel in motion is added to the base to give it three points of support, ensuring that the movement of the equipment is more convenient and flexible.

Utility model CN202187783 is a concrete machine which includes a mixing device, a transportation device, and a concrete injection device. The mixing device, the transportation device and the concrete injection device are sequentially coupled to each other and placed on a wheeled vehicle. The mixing device consists of a mixing recipient. An entrance for material and a water inlet pipe are provided at one end of the mixing tray, a mixing blade is provided in the mixing vessel, the mixing shaft is connected to an engine and a speed reducer, and the mixing shaft is fitted with a spiral and mixing blades. A concrete output and a dust extraction tube are provided at the other end of the mixture hopper. A concrete pad compartment of the transportation device is the concrete output and is connected to a double-cylinder concrete pump, also connected to a mouthpiece that uses a pressure vent pipe through a concrete transportation tube. The concrete machine is fully equipped, and therefore capable of being freely transported and moved, and is convenient to use.

The drawbacks of the technologies described above lie in the fact that the inventions are complex to build, since the means of transportation are vehicles that are complex and complete, that include operator booths, a chassis, etc., made to reach accessible places that are paved, without obstacles, etc., which in many cases are very expensive to use for smaller construction sites, and above all, to use in areas that are difficult to access, being that they are large. While compact mixers exist, they are only towable, that is, they remain stationary where the trailer places them and cannot be moved because they only have a pair of tires.

There are some mixers that have mobile trolleys, but are totally manual, where there is only one mechanism for turning the cylinder mixer, but they do not have a system that will make the mobile mixer move by itself, it has to be driven by the force of the user.

Therefore, in order to quickly and safely transport concrete mixes and other types of construction products through narrow roads and roads that are filled with obstacles such as potholes, rocks, or the obstacles caused by the very materials that are sometimes temporarily stored near construction sites such as piles of sand, gravel or cement that are poorly distributed and hinder access to transport materials to various locations at construction sites, a compact vehicle was developed for preferably transporting a concrete mixing cylinder, which is described below.

DETAILED DESCRIPTION OF THE INVENTION

The details specific to this invention are clearly shown in the following description, and in the attached figures and examples, which illustrate one of the preferred modalities, and must not be construed as limiting this invention.

EXAMPLE

With reference to these figures, the following describes one of the preferred methods to make the invention of the vehicle for the transportation of construction materials to hard to reach areas, of this invention, which is merely illustrative, but must not be construed as a limitation thereof.

Figure 1:
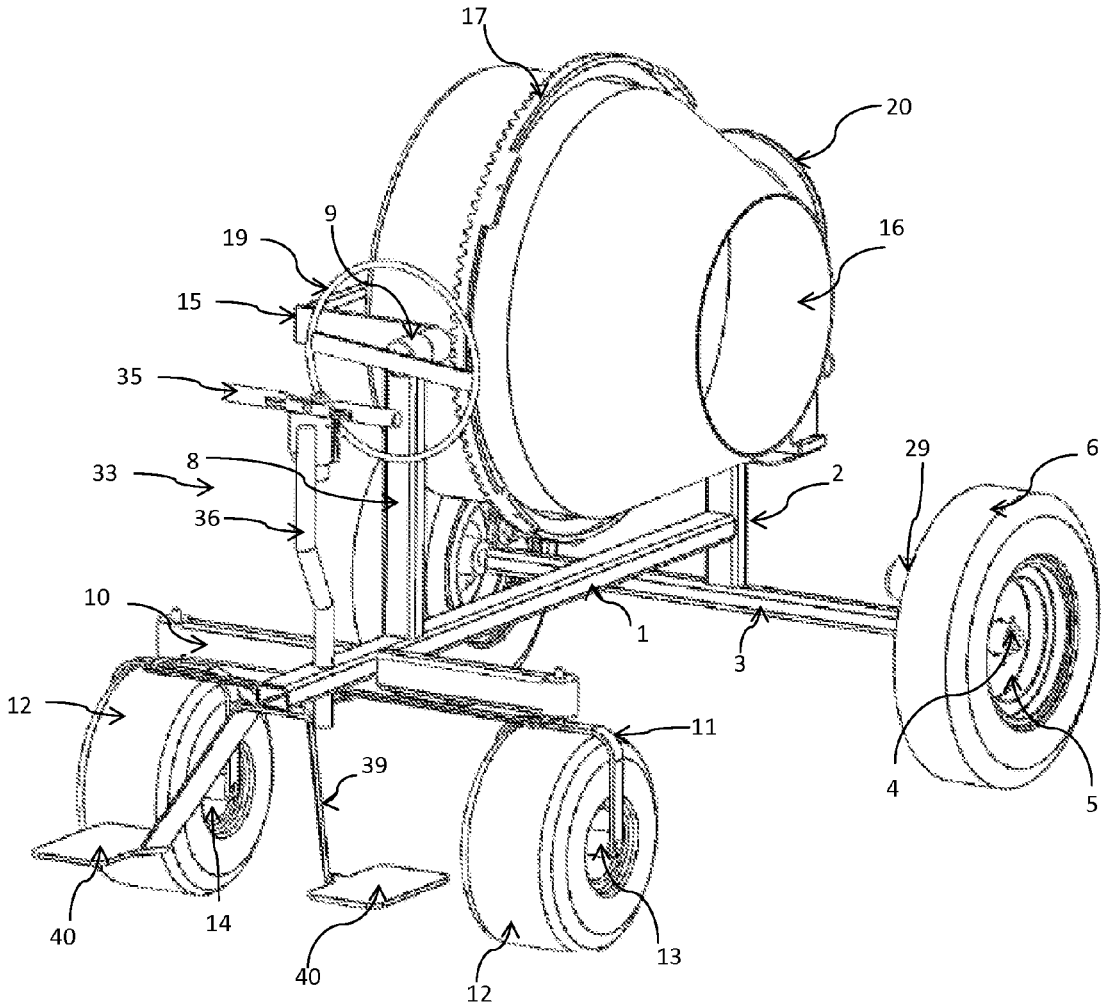
FIG. 1 is a front view of the vehicle for transporting construction materials in hard to reach areas, of this invention.
Figure 2:
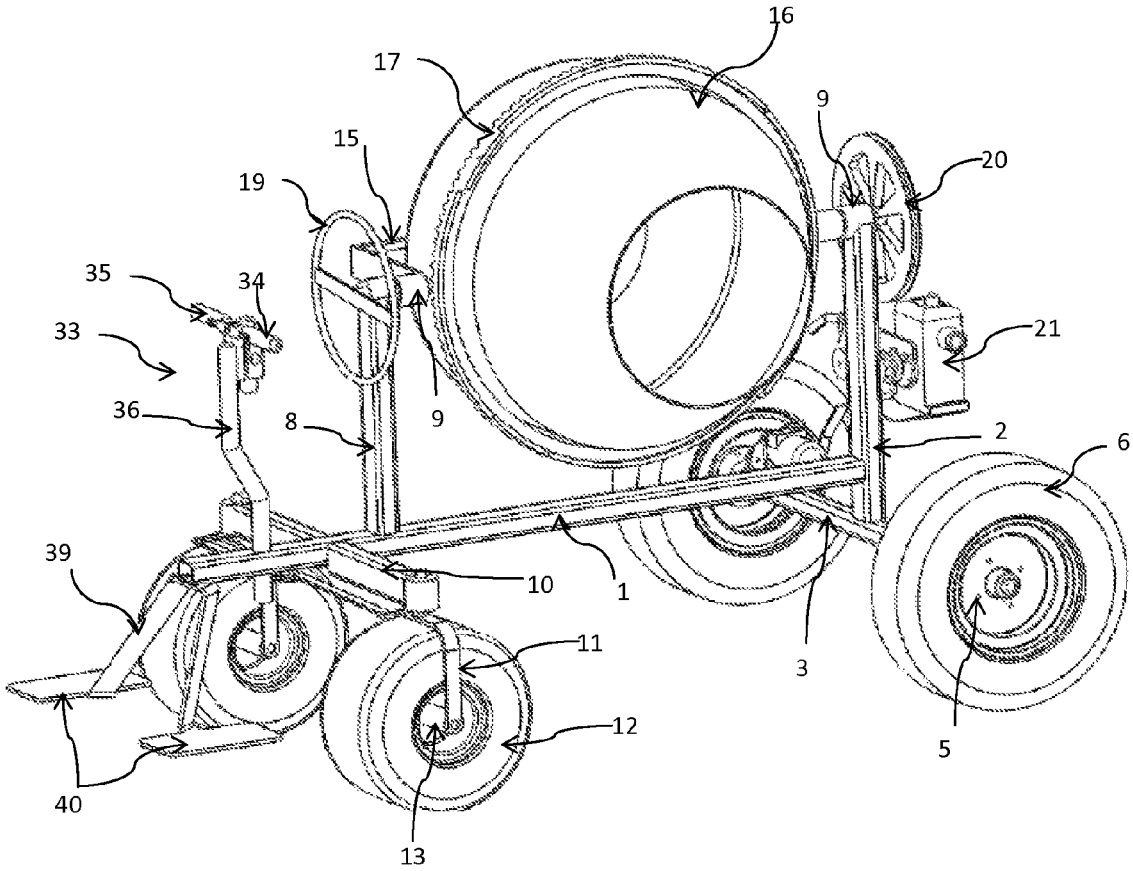
FIG. 2 is a right side view of the vehicle of this invention.
Figure 3:
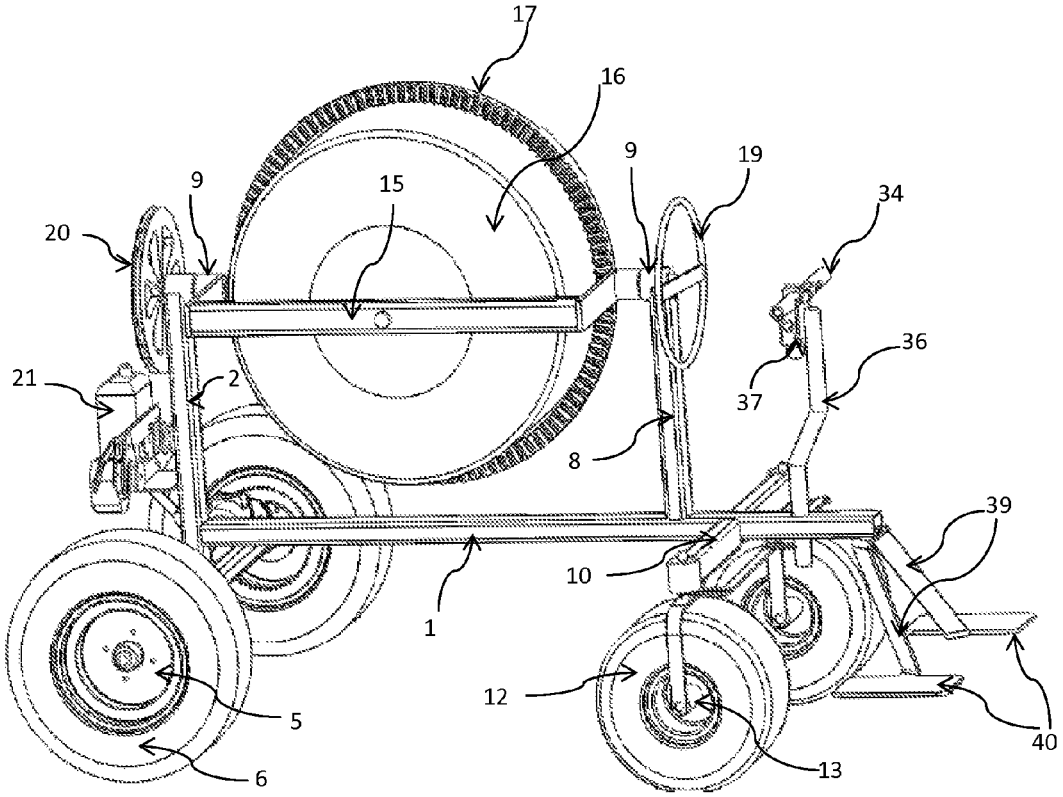
FIG. 3 is a left side view of the vehicle in question.
Figure 4:
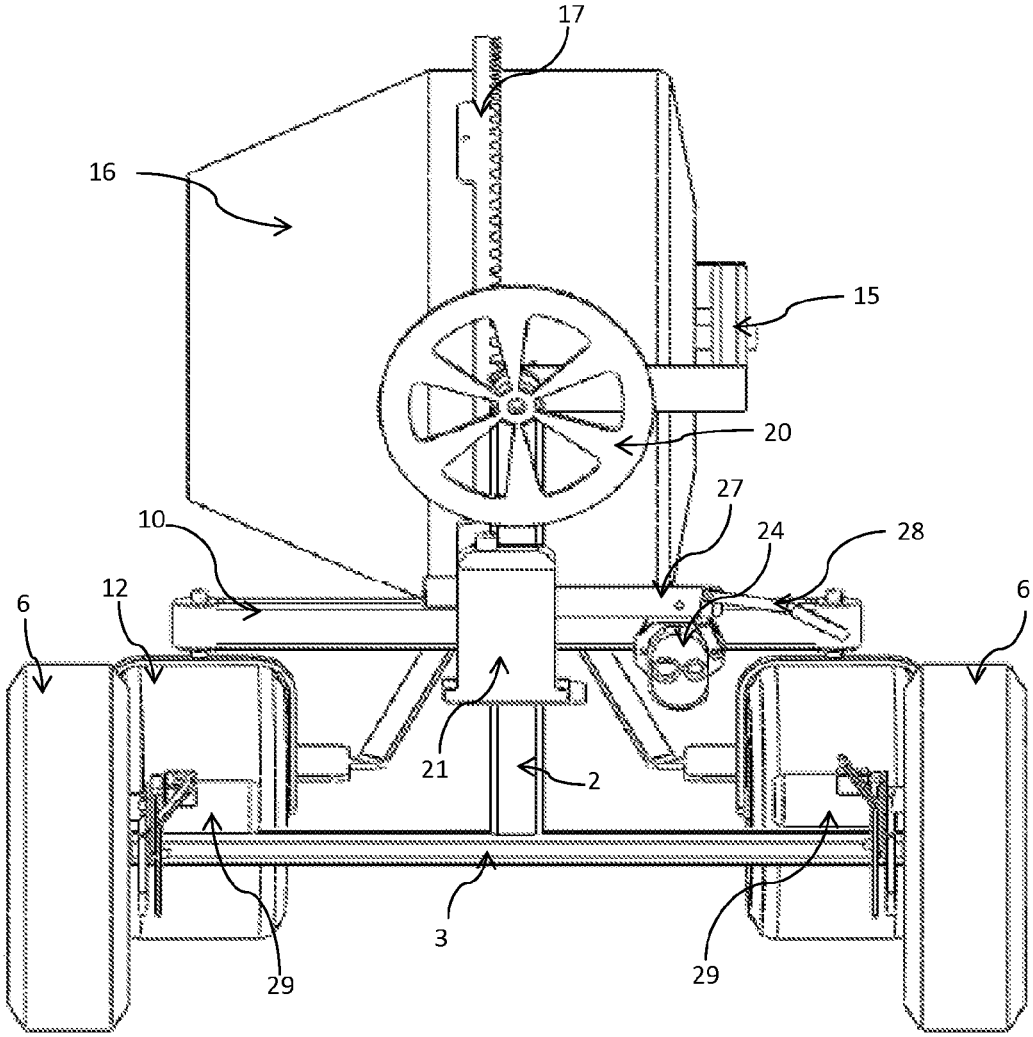
FIG. 4 is a rear view of the vehicle.
Figure 5:
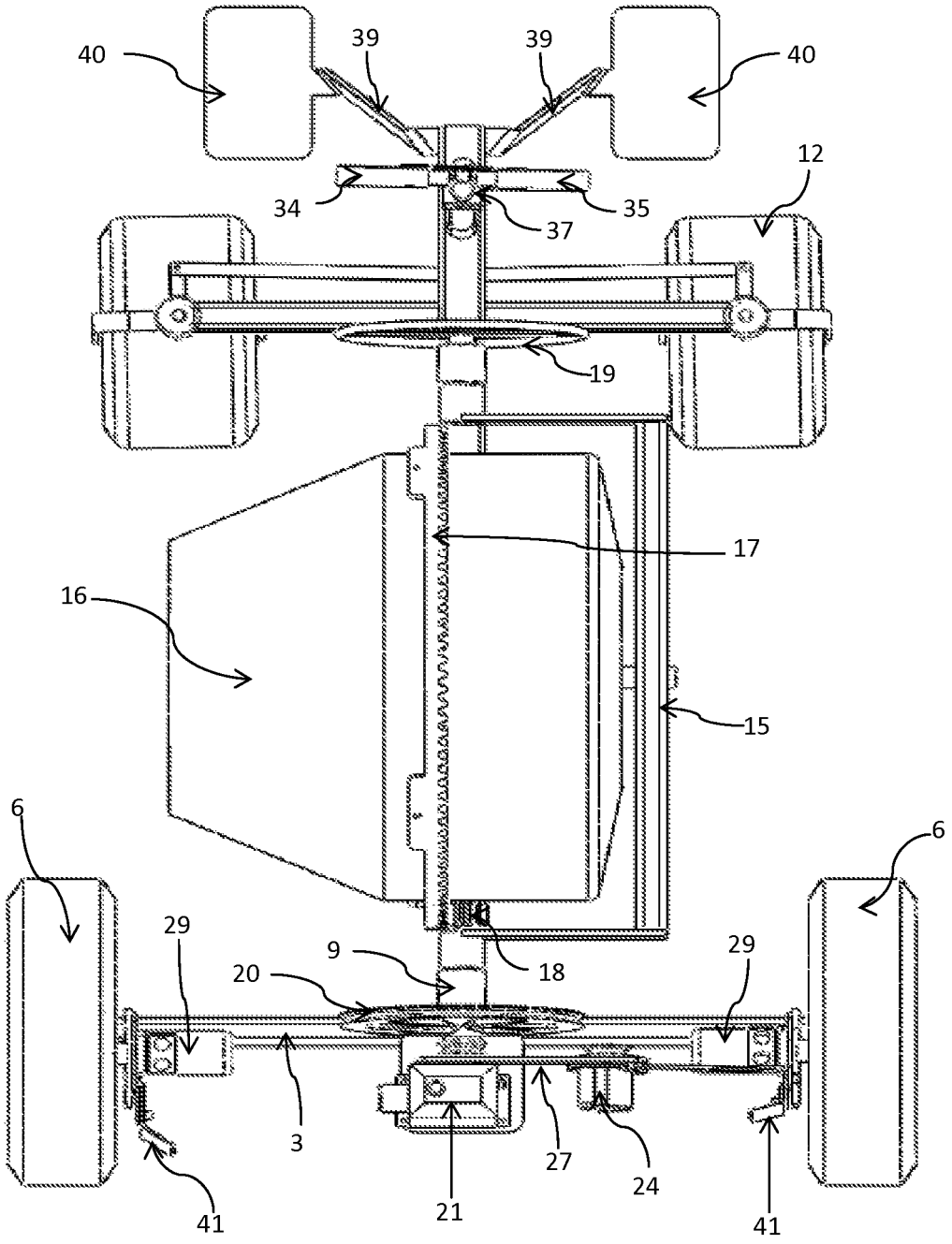
FIG. 5 is a top view of said vehicle.
Figure 6:
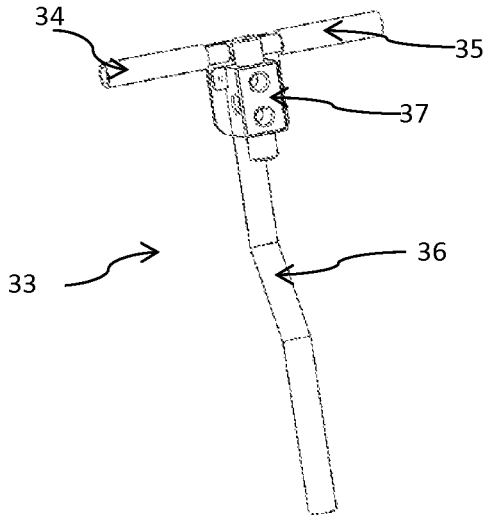
FIG. 6 is a conventional perspective view of the handlebar of the vehicle in question.
Figure 7:
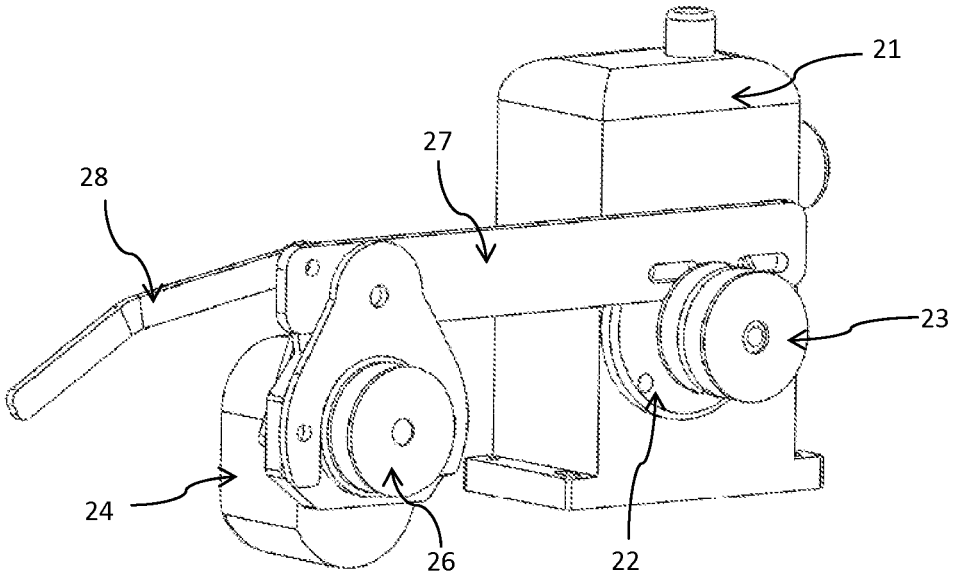
FIG. 7 is a conventional perspective view of the pump of said vehicle.

The vehicle consists of a horizontal chassis, made of axles and posts, manufactured in metal profiles and plates. Said chassis consists of a central longitudinal axle (1), whose left side connects perpendicularly to a vertical rear post (2), toward the lower end of said rear post (2), but without reaching the edge of said end, since that edge is fastened to a rear transverse axle (3), forming an upside-down "T," as clearly seen in FIG. 2; at each end of this rear transverse axle (3), a bearing is located (4), which is used to rotate a rear rim (5), which is equipped with a rear tire (6) which has an internally geared ring (7) on its internal face, so that the rear wheel (6) can be driven by mechanical means.

A front post (8) is situated perpendicularly, close to the right end of the central axle (1), as well as the rear (2) and front posts (8). They are located at the same height in parallel, and a rotary drum (16) is in the space between them, described below. It is worth adding that both the rear post (2), as well as the front post (8), each in turn have a bearing (9) at their top end, to connect a fastener for the rotary drum (16).

A front transverse axle (10) located horizontally and perpendicularly below the right end of the central axle (1), has a fastener on each end (11) for front wheel tires (12), where said fastener is similar to an inverted "U," whose ends have holes drilled to attach bearings (13), which in turn are attached to the center of a front rim (14).

A towing device extension (not shown), which is made up of an axle section of smaller dimension than the center axle (1), so that it can be inserted into the front end of the central axle (1). Said towing device extension has perforations distributed in such a way as to be equidistant to each other along its length. In this manner, it is enough to match the drilled perforation of the center axle (1) with any of the drilled perforations that may be near the rear end of the towing device extension to secure them, keeping them fixed in position by means of a screw and nut in such a way as to control the distance that this vehicle keeps with respect to another vehicle that may tow it. This extension has optional folds similar to an "S" shape, providing it with a slope that allows it to be adjusted to the height of the trailer. In this way, we get a vehicle that, in addition to being autonomous, can be towed.

The vehicle in this example includes a device for the mixing and pouring of a mixture, where said device has a fastener attaching it to a rotary drum (15), which is shaped like a "horizontal U" with straight edges that are held by their ends, which are attached to the front and rear bearings (9) of the front (8) and rear posts (2), respectively, in this way the fastener (15) turns; in addition, said fastener (15) has in its interior a rotary drum (16), which is basically a metal container similar to a barrel, within which the materials to be mixed are poured and stirred (cement, gravel, sand and water), which are stirred, then mixed until a paste of homogeneous consistency is formed. Said rotary drum (16) is soldered to the base of the (15) rotary drum fastener, so that they can be balanced together. It is worth noting that the outer portion of the rotary drum (16) contains teeth like a gear (17) at the center, which are used to make the rotary drum turn (16), inside the fastener (15) for the rotary drum. It is worth mentioning that the bearing (9), of the rear post (2), has a gear coupled to its right front, (18), which in turn is coupled to the geared ring (17), to make the rotary drum turn (16); a steering wheel (19) that turns thanks to the bearing (9) located at the upper end of the front post (8), is used for the operator to manually balance the fastener (15) for the rotary drum, tilting it to pour the material.

A pulley (20) is provided to turn the cylinder (16), which is placed on the arrow of the bearing (9), located in the upper end of the rear post (2), where the pulley (20) makes the gear (18) located in the arrow of said pulley (20) turn, which moves the rotary drum, and said larger pulley obtains its power from a transmission system.

Therefore, said vehicle has a transmission system, consisting of a combustion engine (21), mounted on a platform next to the lower end of the rear post (2). Said combustion engine (21), has two functions; on the one hand, it provides motion to the vehicle, and on the other, it turns the rotary drum (16) by means of a pulley (22) that is connected by an elastic band (not shown) to the pulley (20) that makes the cylinder turn (16), which turns the mixture of materials and stirs it inside the rotary drum.

To provide energy to the vehicle, the combustion engine (21) has a pulley (23) which in turn makes a pump (24) function, with pressure and suction connections, which are connected by means of hoses (25) to a valve (37) described below. As for the pulley (23), it is connected by a band to a pulley (26), which is coupled to the pump (24), where the latter two are activated by means of a metal strip (27) that is connected to a lever (28), which, once engaged, moves from the center to the pulley (26), along the metal strip (27), and thus loosens the band, disabling the pulley (23), so that all the energy of the combustion engine (21) is used only by the rotary drum (16).

It is important to add that the pump's pressure and suction connections (24), are connected respectively to a hydraulic router (30), which is on a platform in the central part of the rear transverse axle (3); said router (30) has suction and pressure connections located on its front, which are connected by means of hoses (25) to the valve (37), the right and left side of the above-mentioned hydraulic router (30) also have suction and pressure connections which are connected by means of hoses (25) to the connections on the hydraulic engines (29) located at each end of the rear transverse axle (3), near the inner faces of each rear rim (5), to provide the vehicle with motion; therefore, these hydraulic engines (29) have a transmission gear (32) of a smaller diameter, coupled inside the geared ring (7).

Figure 8:
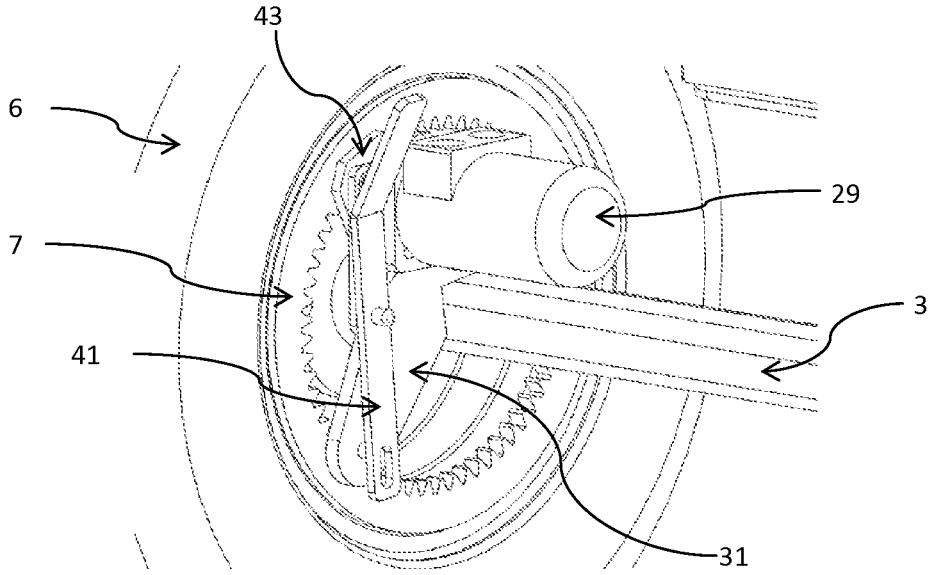
FIG. 8 is a conventional perspective view of an approach of the union of a rear wheel with a rear transverse axle, where a hydraulic engine can be observed.
Figure 9:
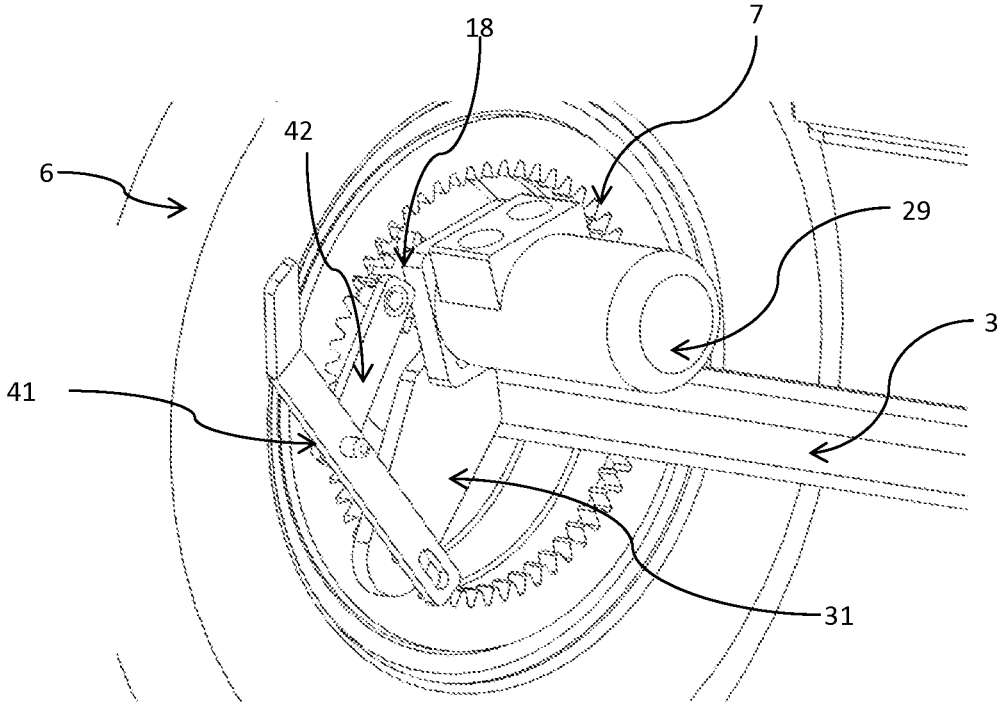
FIG. 9 is a detailed view of the rear tire that is detached from the transmission.
Figure 10:
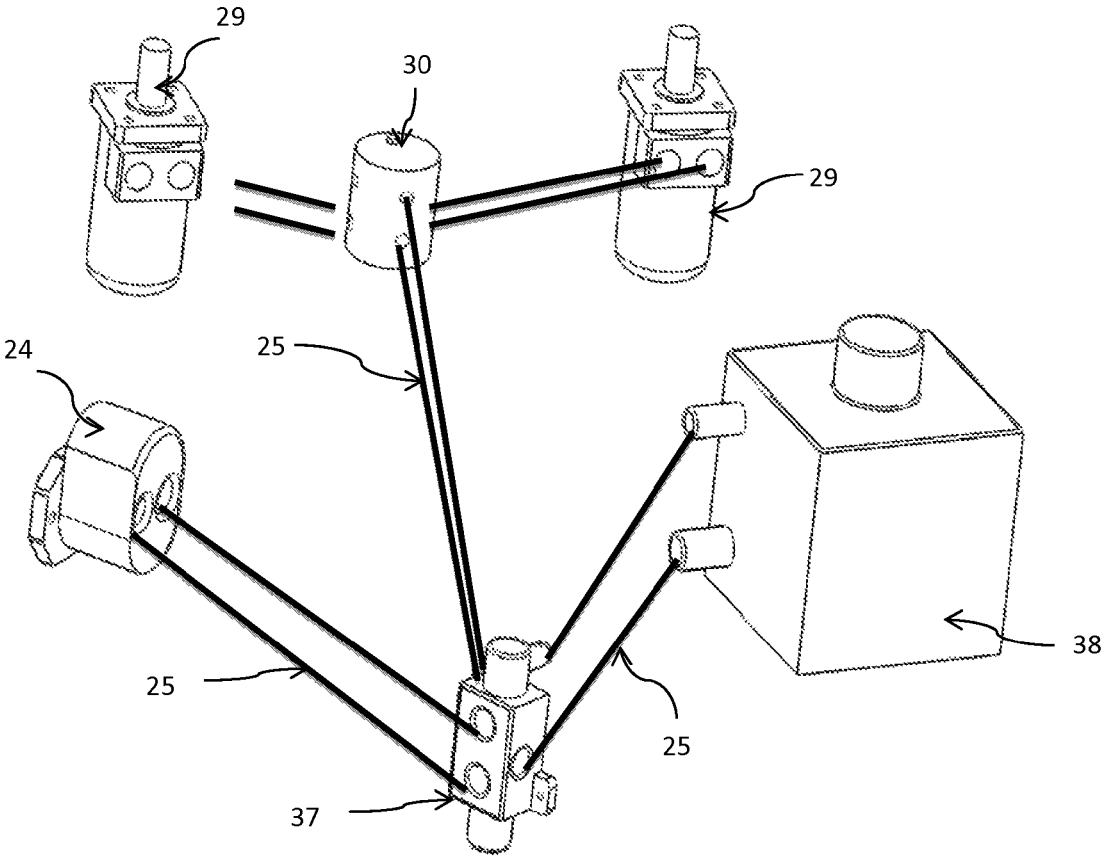
FIG. 10 is a schematic diagram of the vehicle's hydraulic connections.

A mechanism to secure the vehicle is provided, where said mechanism consists of a support (31) in the form of an arm, whose central part is designed to be mounted at right angles on the rear transverse axle (3). The hydraulic engine (29) is placed on said support (31), preferably on the left edge. At the edge of the right end of the bracket (31) a lever is placed vertically (41), which is joined by a connector (42) with a plate (43) that is fixed to the rear transverse axle (3), exactly between the hydraulic engine and the tire rim. With this mechanism, it is possible to secure the vehicle in the place where it is to be used. In order to do this, it is sufficient to simply pull the lever (41) (open) and secure it with the connector so that the tires are secured, as shown in FIG. 9; and when one intends for the tires to roll, the lever is pulled (41) (close) and the connector is disconnected, allowing the vehicle to move, see FIG. 8.

This vehicle also includes a steering system to control the vehicle, which is comprised of a handlebar (33), which is responsible for directing and controlling the speed of the vehicle, since the accelerator (34) and brake (35) are located on the handlebar as they are in motorcycles. Toward the right end of the major axle (1), a drilled hole is located, within which is a bearing, where a handlebar post is inserted perpendicularly and is allowed to rotate freely (36); whose upper end has the valve (37), attached to the handlebar (36) post (33), which has its respective pressure and suction connections to receive the hoses (25) from the hydraulic router (30), in this way it controls it, although it is important to add that when the throttle is turned, the combustion engine is also accelerated (21) injecting pressure on the hydraulic router (30) which then turns the hydraulic engines (29) and moves the vehicle; to brake, the throttle should be released, which gradually returns to its initial position, while the vehicle loses speed. The aforementioned handlebar (37) valve has pressure and suction connections on its right side that are connected by hoses (25) to the respective pump connections (24), while its left side connections are connected by hoses (25) to the suction and return connections of an oil tank (38), which in turn has a filter.

The vehicle has a foot rest made of metal strips (39) where their upper ends are joined to the front end of the central axle (1), and their bottom ends are separated and each have a small horizontal platform (40) to support the operator's feet.

As mentioned above, this description was only one of many examples to make this vehicle, as all of its components can be made in various methods, forms, shapes, sizes, and of various materials, among others; which are included within the scope of this patent application; as these methods are obvious to an expert in the field.

To cite some of the changes that this invention can have, it is mentioned that the chassis can be made out of different elements in terms of its arrangement in space, shape, dimensions, materials, etc. What is important is that this chassis be capable of including three, at least; the means to support a container of materials, preferably for construction; a transmission system, and a vehicle steering and control system, among others.

Where the transmission system is concerned, this can be set up in different ways, the number and size of the engines is variable, which will depend on the size of the vehicle. Likewise, energy sources that give movement to the rotating cylinder (16) may be the engine (21) that gives the vehicle motion, or it can have its own engine. For example, the combustion engine can be omitted (21), and instead, a hydraulic engine may be placed directly underneath the rotary drum fastener (16) to make it turn.

While it is true that the vehicle of this invention was made to transport concrete mixes by means of a conventional rotary drum (16); it is very obvious to an expert in the field that the vehicle can carry other types of construction materials, for which, it is enough to make small obvious modifications to achieve this. That is, instead of a rotary cylinder (16), there could be a container, a basket, a mechanical shovel for digging, or any other means to contain the type of construction material to transport, such as blocks, bricks, adobe, modules, sand, gravel, soil, sacks of cement, lime, gypsum; liquids such as water, paints, sealers; debris, rubbish, soil; among others, to give some examples.

Therefore, the aforementioned list of means set up to contain the above-listed type of material and list of materials is merely illustrative, but must not be construed as limiting this invention.

Another more specific example is that the vehicle can consist of a single hydraulic engine (29) and have a drive axle for the other front wheel; and furthermore, the transmission system can be placed in the front wheels of the vehicle.

Another way to make the vehicle is for it to not have a steering system and for the hydraulic engines (29) to be independent, and for it to be steered as a backhoe.

Another variant of the vehicle is that the rear transverse axle (3) may be extensible and/or retractable. For example, the tires may be fastened to an axle introduced into the rear transverse axle (3), in such a way that the tires slide outwardly; this is done in order to give more balance to the vehicle when it is towed.

Another variant is that the pump (24) can be driven directly by the motor shaft (21) or a gas engine may be added, that is, without the need for pulleys or belts.

In this way, we have a vehicle for many uses, preferably within the scope of construction; where its main characteristics are that it is self-propelling thanks to its transmission system, and towable due to its towing device extension. Therefore, the benefits achieved with the vehicle of this invention are many, and they are listed below:

It can rapidly transport mixtures and other construction materials.

It has a reduced number of parts.

It can be driven on almost every type of terrain which is difficult to access.

It is easy to handle and maintain.

The invention claimed is:

1. A vehicle for transporting construction materials, in places that are difficult to access, comprising:

i) a horizontal chassis, formed by a longitudinal central axle (1), whose rear end joins a rear transverse axle (3), and toward its front end, but without reaching the very edge, a means of attachment is provided at the bottom to fasten (10) at least one wheel;

ii) at least three wheels (6), which are arranged vertically, one on each end of the rear transverse axle (3) and the other in the front half (10) to fasten a wheel;

iii) a couple of posts vertically parallel to each other (2 and 8) are placed perpendicularly to the longitudinal central axle (1), where the rear post (2) is placed in the rear end of the central axle (1), and the front post (8) is preferably placed before the location of the front half (10) that fastens the wheels; leaving the upper ends of these posts (2 and 8) at the same level; these posts (2 and 8) have elements to hold a means (16) on which the construction material to be carried is placed;

iv) a means (16) where the construction material to be transported is placed;

v) a transmission system consisting of a combustion engine (21) to provide, on the one hand, vehicle movement, and on the other hand, to activate the means (16) that contains the construction material, in case it is required; the combustion engine (21) has a pulley (23) that is used to operate a pump (24) with pressure and suction connections, which are connected by means of hoses (25) to the respective connections of a valve (37); the pulley (23) is connected by means of a band to a pulley (26) that is attached to the pump (24), where both are activated by means of a metal strip (27) that is connected to a lever (28), which, once engaged, moves the pulley from its center (26) by means of the metal strip (27), thus loosening the band and disabling the pulley (23), so that all the energy of the combustion engine (21) is used by the containing means (16); a conventional hydraulic router (30) on a platform in the central area of the rear transverse axle (3), is connected to the pump (24), by means of the respective pressure and suction connections, said router has pressure and suction connections located on its front that are connected by means of hoses to the respective valve connections (37), and on their right and left sides they also have suction and pressure connections which are connected by hoses to the connections of, at least, a hydraulic engine (29) located at the end of the rear transverse axle (3), close to the inner face of each rear wheel rim (6); and vi) a mechanism to secure the vehicle is provided, consisting of a support (31) in the form of an arm, whose central part is designed to be mounted at right angles on the rear transverse axle (3), the hydraulic engine (29) is placed on said support (31), preferably on its left end; at the right edge of the bracket (31) a lever is vertically placed (41), which is attached by means of a connector (42) to a plate (43) that is fastened to the rear transverse axle (3), exactly between the hydraulic engine (29) and the wheel rim.

2. The vehicle of claim 1, wherein the central longitudinal axle (1) is attached to the rear post (2), instead of the rear transverse axle (3).

3. The vehicle of claim 1, wherein the means of attachment (10), of at least one wheel is a front transverse axle.

4. The vehicle of claim 1, wherein a wheel is placed at each end of the front transverse axle.

5. The vehicle of claim 1, wherein at least one of the wheels placed at the rear transverse axle (3), has a geared ring (7) on its internal face, for the wheel to be driven by mechanical means.

6. The vehicle of claim 1, where the combustion engine (21) is mounted on a platform located next to the lower end of the rear post (2).

7. The vehicle of claim 1, wherein the rear post (2) is fastened to the rear transverse axle (3).

8. The vehicle of claim 1, wherein the elements to support the means (16) to place the construction material to be transported are bearings to attach a fastener (15) for a rotary drum (16).

9. The vehicle of claim 1, further comprising a foot rest on the front end of the central axle (1), the foot rest is formed by two hanging rigid strips (39), that are open among themselves, to which a horizontal platform is added at their lower end (40) where an operator can place their feet.

10. The vehicle of claim 1, wherein the means where the construction material to be transported is placed is selected from the group consisting of a rotary drum (16), a basket, and a mechanical shovel for digging.

11. The vehicle of claim 10, wherein the rotary drum is of the type that is used to mix and pour concrete or similar mixtures, the rotary drum including a steering wheel (19) that rotates thanks to the bearing located at the upper end of the front post (8), the steering wheel is configured to manually balance the rotary drum, the rotary drum is tilted to pour its material.

12. The vehicle of claim 1, wherein the part of the transmission system that provides the turning motion for the cylinder mixer, conforms to the motor's (21) pulley (22), which connects with a rubber band to an upper pulley (20) located at the rear end of the bearing (9), which in turn is at the top end of the rear post (2); a gear (18) is located on the tip of the arrow in the upper pulley (20) so that said gear (18) makes contact with the geared ring (17) of the cylinder (16), and in this way set the rotary drum in motion.

13. The vehicle of claim 1, further comprising a towing device extension.

14. The vehicle of claim 13, wherein the towing device extension has folds that form a slope, that allow adjustment to the height of the vehicle.

15. The vehicle of claim 1, wherein the construction material to be transported is selected from the group consisting of concrete mixtures, concrete, Portland cement, lime and sand, mud, blocks, bricks, sand, gravel, soil, sacks of lime, cement, gypsum, liquids, water, paints, sealers, debris, rubbish, and soil.

16. The vehicle of claim 1, wherein the hydraulic engine turns a rotary drum (16) instead of the combustion engine (21).

17. The vehicle of claim 1, wherein the hydraulic engine is placed directly underneath the fastener (15) of a rotary drum (16).

18. The vehicle of claim 1, wherein the rear transverse axle (3) is configured to be extensible and retractable and the wheels are held in an axle that is inserted into the rear transverse axle (3) in such a way that the tires slide outwardly, so that more balance is provided to the vehicle when it is towed.

19. The vehicle of claim 1, wherein the pump (24) is driven directly by the combustion engine (21) or by another gas engine that may be added.

20. The vehicle of claim 1, further comprising a vehicle steering and control system, the vehicle steering and control system including a handlebar (33) supported at the upper end by a vertical post (36), which is then inserted into the front end of the central axle (1) without reaching the edge of the end, where the vertical post has a turning motion on its axis; a throttle (34) and a brake (35) are provided on the handlebars; a valve (37) is provided at the top of the vertical post (36), next to the handlebar (33), which has connections with sufficient suction and pressure hoses to receive the hoses coming from the hydraulic router (30), from the pump (24) and from an oil tank (38) with a filter.

* * * * *